US009723396B2

(12) United States Patent
Qian et al.

(10) Patent No.: US 9,723,396 B2
(45) Date of Patent: Aug. 1, 2017

(54) EARPHONE ASSEMBLIES WITH MAGNETS FOR ANCHORING TO A USER

(71) Applicant: Apple Inc., Cupertino, CA (US)

(72) Inventors: Phillip Qian, Cupertino, CA (US); Scott C. Grinker, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/192,084

(22) Filed: Jun. 24, 2016

(65) Prior Publication Data

US 2016/0381448 A1 Dec. 29, 2016

Related U.S. Application Data

(60) Provisional application No. 62/186,190, filed on Jun. 29, 2015.

(51) Int. Cl.
*H04R 1/10* (2006.01)
*H04R 1/02* (2006.01)

(52) U.S. Cl.
CPC ..... *H04R 1/105* (2013.01); *H04R 1/1016* (2013.01); *H04R 1/1041* (2013.01); *H04R 2420/07* (2013.01)

(58) Field of Classification Search
CPC .. H04R 25/606; H04R 25/602; H04R 25/554; H04R 25/65; H04R 2225/021; H04R 2225/31; H04R 2225/51; H04R 9/06; H04R 1/02; H04R 1/10; H04R 1/105; H04R 1/1025; H04R 1/1041; H04R 1/1016; H04R 2420/07
See application file for complete search history.

(56) References Cited

U.S. PATENT DOCUMENTS

| | | | | |
|---|---|---|---|---|
| 4,429,194 | A | 1/1984 | Kamon et al. | |
| 8,086,288 | B2 | 12/2011 | Klein | |
| 8,111,854 | B2 | 2/2012 | Peng | |
| 8,472,660 | B2 | 6/2013 | Wengreen | |
| 2007/0160245 | A1* | 7/2007 | Peng | H04R 1/10 381/334 |
| 2008/0123890 | A1* | 5/2008 | Peng | H04R 1/1075 381/338 |
| 2010/0217103 | A1 | 8/2010 | Abdul-Hafiz et al. | |

FOREIGN PATENT DOCUMENTS

| | | |
|---|---|---|
| EP | 1843627 | 10/2007 |
| GB | 2379029 | 2/2003 |
| WO | 2004/004416 | 1/2004 |

* cited by examiner

*Primary Examiner* — Thang Tran
(74) *Attorney, Agent, or Firm* — Van Court & Aldridge LLP

(57) ABSTRACT

Earphone assemblies with magnets are provided to anchor the assemblies to a user during use.

19 Claims, 5 Drawing Sheets

100

EARPHONE ASSEMBLIES WITH MAGNETS FOR ANCHORING TO A USER

CROSS-REFERENCE TO RELATED APPLICATION(S)

This application claims the benefit of prior filed U.S. Provisional Patent Application No. 62/186,190, filed Jun. 29, 2015, which is hereby incorporated by reference herein in its entirety.

TECHNICAL FIELD

This can relate to earphone assemblies and, more particularly, to earphone assemblies with magnets for anchoring to a user.

BACKGROUND OF THE DISCLOSURE

Earphone assemblies are often worn by users that are exercising or performing other activities. However, such active use often dislodges an earphone assembly from its functional position with respect to a user's ear.

SUMMARY OF THE DISCLOSURE

Earphone assemblies with magnets are provided for anchoring to a user during use.

As an example, an earphone assembly for use by a user's ear may be provided that may include a hook member including a functional component, a body, an audio output component positioned at least partially within the body, a first magnet physically coupled to the body, and a second magnet, wherein, when the body is positioned against the user's ear in a functional position that is operative to direct sound from the audio output component into the user's ear, the first magnet and the second magnet are operative to be positioned on opposite sides of a wall of the ear and are operative to be magnetically attracted to one another via the wall for holding the body in the functional position, and wherein a first end of the hook member is physically coupled to the body, a second end of the hook member is a free end, the second magnet is coupled to the hook member adjacent the second end of the hook member, and the functional component includes at least one of an antenna functionally coupled to the audio output component and a battery functionally coupled to the audio component.

As another example, an earphone assembly for use by a user's ear may be provided that may include a body, an audio output component positioned at least partially within the body, a hook member including a first end physically coupled to the body, a second end that is a free end, and a hook member part extending between the first end and the second end, a first magnet physically coupled to the body, a second magnet provided at a first position along the length of the hook member part, and a third magnet provided at a second position along the length of the hook member part, wherein, when the body is positioned against the user's ear in a functional position that is operative to direct sound from the audio output component into the user's ear, the first magnet and the second magnet are operative to be positioned on opposite sides of a first portion of a wall of the ear and are operative to be magnetically attracted to one another via the first portion of the wall for holding the body in the functional position, and, when the body is positioned against the user's ear in another functional position that is operative to direct sound from the audio output component into the user's ear, the first magnet and the third magnet are operative to be positioned on opposite sides of a second portion of the wall of the ear and are operative to be magnetically attracted to one another via the second portion of the wall for holding the body in the other functional position.

As yet another example, an earphone assembly for use by a user's ear may be provided that may include a body, an audio output component including a first magnet positioned at least partially within the body and a second magnet, wherein, when the body is positioned against the user's ear in a functional position that is operative to direct sound from the audio output component into the user's ear, the first magnet and the second magnet are operative to be positioned on opposite sides of a wall of the ear and are operative to be magnetically attracted to one another via the wall for holding the body in the functional position.

This Summary is provided only to summarize some example embodiments, so as to provide a basic understanding of some aspects of the subject matter described in this document. Accordingly, it will be appreciated that the features described in this Summary are only examples and should not be construed to narrow the scope or spirit of the subject matter described herein in any way. Unless otherwise stated, features described in the context of one example may be combined or used with features described in the context of one or more other examples. Other features, aspects, and advantages of the subject matter described herein will become apparent from the following Detailed Description, Figures, and Claims.

BRIEF DESCRIPTION OF THE DRAWINGS

The discussion below makes reference to the following drawings, in which like reference characters refer to like parts throughout, and in which.

DETAILED DESCRIPTION OF THE DISCLOSURE

Earphone assemblies with magnets are provided and described with reference to FIGS. 1-3C.

This disclosure describes a system to improve stability for earphones (e.g., wired or wireless in-ear earphones or for any other suitable type of earphones), particularly for active and sport use cases where the earphones can move and/or become dislodged, either ruining the sound quality or falling out completely from a functional position with respect to a user's ear. A strong rare earth magnet may be over-molded into or otherwise provided by an ear hook or any other suitable part of an earphone assembly, and a similar magnet may be integrated into an earphone housing (e.g., beneath or on or within an outer surface of a housing (e.g., an earbud housing or other suitable housing that may at least partially contain driver circuitry for the assembly (e.g., a plastic housing))). In such embodiments, the design of the ear hook and housing may be operative to locate the hook near the rear of the concha bowl cavity and/or scapha of the user's ear (e.g., where thin cartilage and/or thin tissue may exist). Therefore, through use of the magnets, the ear hook may magnetically attach to the housing through the ear tissue that may exist between the hook and housing, thereby anchoring the assembly to the pinna or any other suitable portion of the user's ear. Multiple magnetic points may be provided to allow for different ear sizes. The assembly may also include a sensor that may be integrated into or otherwise provided by the earphones at a location to be anchored against a user's ear for improving reliability with skin contact between the ear and such a sensor.

Figure 1:
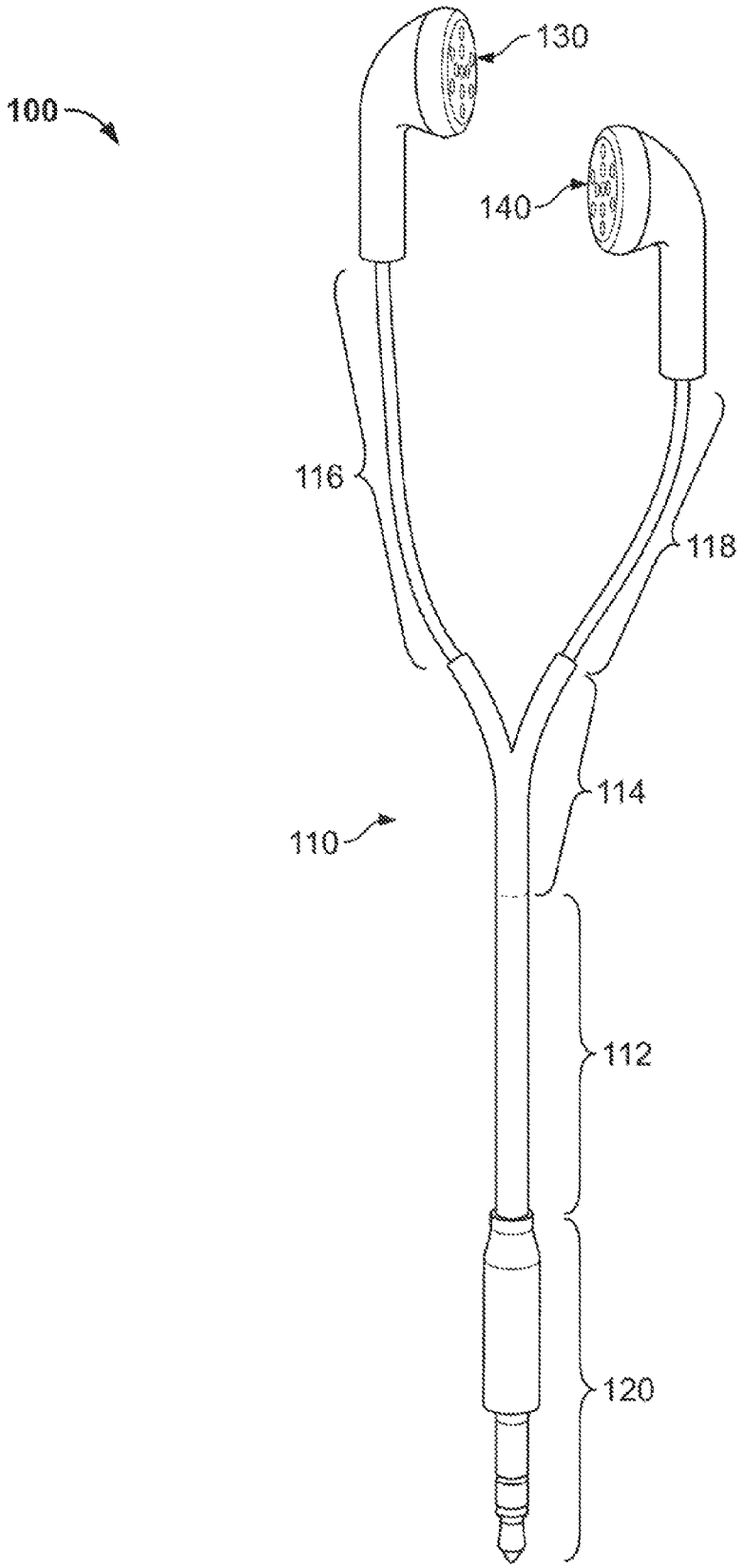
FIG. 1 is a perspective view of an illustrative earphone assembly.

Any suitable earphone or headset assembly may be provided with one or more magnetic elements for securing the assembly to a user. For example, as shown in FIG. 1, a cabled headset assembly 100 may include a cable 110 that can electrically couple an audio connector component 120 to a left speaker component 130 and/or a right speaker component 140. Cable 110 may include a main region 112 that may extend between audio connector component 120 and a bifurcation (e.g., forked region) 114 of cable 110. Cable 110 may also include a left region 116 that may extend between bifurcation 114 and left speaker component 130. Alternatively or additionally, cable 110 may include a right region 118 that may extend between bifurcation 114 and right speaker component 140. Any one or more of cable regions 112, 114, 116, and 118 of cable 110 may include one or more conductors that may be configured to transmit data and/or power signals between audio connector component 120 and one or both of left speaker component 130 and right speaker component 140. Cabled headset assembly 100 may be configured to communicate any suitable data signals, such as audio signals, video signals, control signals, and the like with a media device. Connector component 120 may be operative to be physically coupled to any suitable connector of any suitable media device (not shown) for enabling communication between assembly 100 and such a media device. Alternatively, assembly 100 may not include a connector component 120 but may be operative to wirelessly communicate with such a media device.

Figure 2:
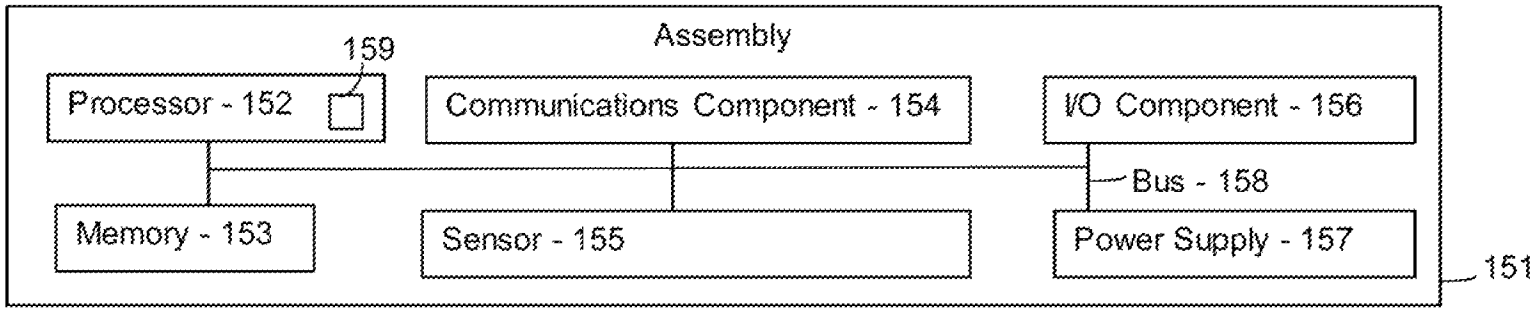
FIG. 2 is a schematic view of the illustrative earphone assembly of FIG. 1.

As shown in FIG. 2, and as described in more detail below, assembly 100 may include a processor component 152, a memory component 153, a communications component 154. a sensor component 155, an input/output ("I/O") component 156, a power supply component 157, and/or a bus 158 that may provide one or more wired or wireless communication links or paths for transferring data and/or power to, from, or between various other components of assembly 100. I/O component 156 may include at least one input component (e.g., button, mouse, keyboard) to receive information from a user and/or at least one output component (e.g., audio speaker, video display, haptic component) to provide information to a user, such as a touch screen that may receive input information through a user's touch of a display screen and that may also provide visual information to a user via that same display screen. Memory 153 may include one or more storage mediums, including for example, a hard-drive, flash memory, permanent memory such as read-only memory ("ROM"), semi-permanent memory such as random access memory ("RAM"), any other suitable type of storage component, or any combination thereof. Communications component 154 may be provided to allow assembly 100 to communicate with one or more other devices (e.g., a media device) using any suitable communications protocol. Communications component 154 can be operative to create or connect to a communications network. Communications component 154 can provide wireless communications using any suitable short-range or long-range communications protocol, such as Wi-Fi (e.g., a 802.11 protocol), Bluetooth, radio frequency systems (e.g., 1200 MHz, 2.4 GHz, and 5.6 GHz communication systems), infrared, protocols used by wireless and cellular telephones and personal e-mail devices, or any other protocol supporting wireless communications. Communications component 154 can also be operative to connect to a wired communications network or directly to another data source wirelessly or via one or more wired connections (e.g., using any suitable software, firmware, and/or hardware components (e.g., one or more antennas)). Sensor 155 may be any suitable sensor that may be configured to sense any suitable data for assembly 100, such as a biometric sensor (e.g., a heart rate monitor (e.g., photoplethysmogram ("PPG") sensors, electrocardiography ("ECG") sensors, etc.), a light sensor, audio sensor, camera, a global positioning system ("GPS") sensor, and the like. Power supply 157 can include any suitable circuitry for receiving and/or generating power, and for providing such power to one or more of the other components of assembly 100. Processor 152 may be used to run one or more applications, such as an application 159 that may be accessible from memory 153 and/or any other suitable source (e.g., from a media device via a wired or wireless connection). Application 159 may include, but is not limited to, one or more operating system applications, firmware applications, communication applications, internet browsing applications, or any other suitable applications. For example, processor 152 may load an application 159 as a user interface program to determine how instructions or data received via an input component of I/O component 156 or other component of assembly 100 may manipulate the way in which information may be stored and/or provided to the user via an output component of I/O component 156. Assembly 100 may also be provided with a housing 151 that may at least partially enclose one or more of the components of assembly 100 for protection from debris and other degrading forces external to assembly 100. Each component of assembly 100 may be included in the same housing 151 (e.g., as a single unitary device, such as a single earphone) and/or different components may be provided in different housings (e.g., a first housing may include one of each component of FIG. 2 to provide a left earphone for a left ear of a user and a second housing may include at least some of the components of FIG. 2 to provide a right earphone for a right ear of the user). In some embodiments, assembly 100 may include other components not combined or included in those shown or several instances of the components shown.

Figure 3A:
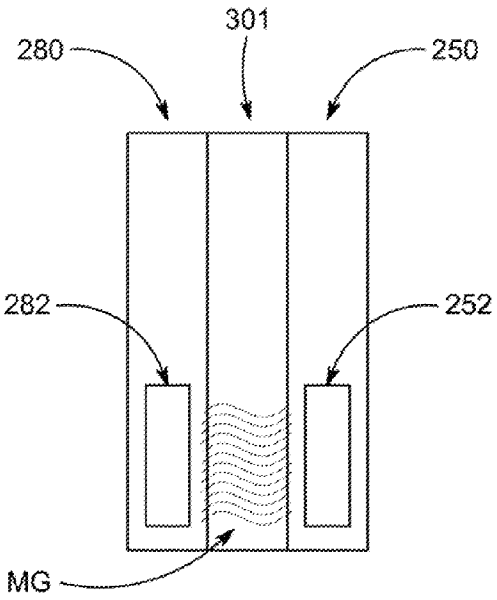
FIG. 3A is a cross-sectional view of a portion of the assembly and user of FIG. 3.
Figure 3:
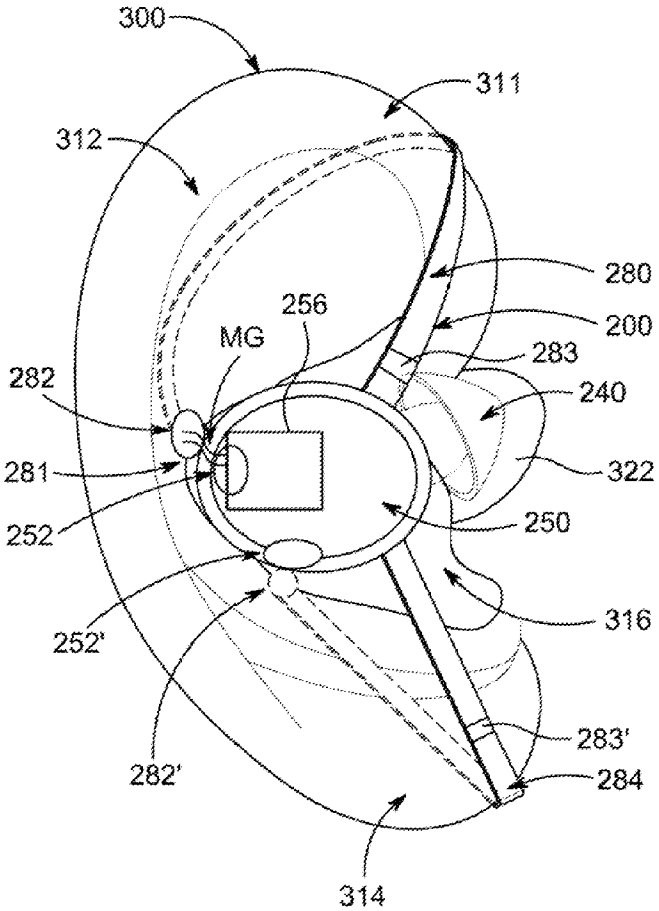
FIG. 3 is a perspective view of another illustrative earphone assembly worn by a user.

As shown in FIG. 3, an earphone assembly 200 may be worn by an ear 300 of a user. For example, assembly 200 may be similar to assembly 100 and/or may include one, some, or all of the components of assembly 100. As shown, assembly 200 may include an earbud housing or body 250 that may include a housing that may at least partially enclose one or more suitable components of assembly 200, such as an audio driver output component, a power supply, a communications component, a sensor, and/or the like (e.g., one or more components similar to one or more components of assembly 100 of FIG. 2). Moreover, as shown, earbud body 250 may include at least one magnet, such as a bud magnet 252 and/or a bud magnet 252' that may respectively be magnetically coupled to an ear hook magnet 282 and/or an ear hook magnet 282', respectively. Body 250 may be coupled to an ear tip 240 that may be operative to be fitted at least partially within an ear canal 322 of ear 300 for directing sound from a driver of assembly 200 (e.g., a driver at least partially provided within body 250 and/or within ear tip 240) into canal 322. In some embodiments, assembly 300 may provide a non-occluding earphone or an earphone that is not configured to be at least partially inserted into the ear canal of the user but that may fit directly in the outer ear and face the ear canal. Alternatively, assembly 300 may provide an occluding earphone or an earphone that is configured to be at least partially inserted into the ear canal of the user (e.g., an in-ear headphone or in-ear monitor or canalphone). At least a portion of assembly 200, such as at least a portion of body 250, may be at least partially positioned within a concha 316 (e.g., a hollow portion adjacent ear canal 322) or any other suitable portion of ear 300 (e.g., the scapha) that may support body 250. In other embodiments, body 250 may be positioned outside of but adjacent to concha 316 (e.g., as an ear cup that may surround at least a portion of concha 316 for directing sound through concha 316 and into canal 322).

As shown in FIG. 3, assembly 300 may include an ear hook member 280 or arm or extension member that may be physically coupled to and that may extend away from body 250. Hook member 280 may have a free end 281 that may be positioned behind ear 300 (e.g., behind pinna 312) when a portion of member 280 is directed away from body 250 up and over helix 311 of ear 300. Member 280 may be made of any suitable material, such as plastic, rubber, glass, and/or the like, that may include at least a flexible coupling with body 250 (e.g., at a body end opposite free end 281) and/or that may be flexible along at least a portion of the length of member 280 for enabling member 280 to be flexible, deformable, and/or reconfigurable so as to be positioned comfortably and/or easily with respect to ear 300 as shown in FIG. 3. At least one magnet 282 may be provided in and/or on member 280 for aligning with at least one magnet 252 of body 250, such that magnet 282 and magnet 252 may attract one another for holding assembly 200 in the position of FIG. 3 with respect to ear 300 (e.g., a functional position at which sound may be effectively emitted from assembly 200 into ear canal 322 of ear 300). As shown in FIG. 3A, magnets 252 and 282 may be aligned for attracting one another with magnetism (e.g., magnetism MG) through ear tissue 301 of any suitable portion of ear 300. In some embodiments, in addition to or as an alternative to hook member 280, another ear hook member 284 may be coupled to and may extend away from body 250. Hook member 284 may include a free end (e.g., similar to free end 281 of hook member 280) that may be positioned behind ear 300 when a portion of member 284 is directed away from body 250 down and under ear lobe 314 of ear 300. Member 284 may be made of any suitable material, such as plastic, rubber, glass, and/or the like, that may include at least a flexible coupling with body 250 (e.g., at an end of member 284 opposite the free end) and/or that may be flexible along at least a portion of the length of member 284 for enabling member 284 to be flexible, deformable, and/or reconfigurable to be positioned as shown in FIG. 3. At least one magnet 282' may be provided in and/or on member 284 for aligning with at least one magnet 252' of body 250, such that magnet 282' and magnet 252' may attract one another for holding assembly 200 in the position of FIG. 3 with respect to ear 300. While magnets 252/282 may be shown in FIG. 3 to cause an attraction along a direction that may be along a path that may be co-linear or substantially collinear with the path of tip 240 away from body 250, magnets 252'/282' may be shown in FIG. 3 to cause an attraction along a direction that may be perpendicular or substantially perpendicular with the path of tip 240 away from body 250 and/or with the path of attraction of magnets 252/282. For example, magnet 282 may be operative to pull magnet 252 sideways against a side inner portion of concha 316, whereas magnet 282' may be operative to pull magnet 252' downward against a bottom inner portion of concha 316.

Any suitable number of magnets provided on or in body 250 may be attracted to respective magnets provided on or in members extending away from body 250 via any suitable portions of ear 300, which may be operative to more securely hold assembly 200 in a functional position with respect to ear 300. Member 280 and/or member 284 may include or otherwise provide or be provided by any other suitable component of assembly 200 besides one or more magnets, such as component 283 of member 280 and/or component 283' of member 284, where component 283 and/or component 283' may be any suitable component as described with respect to components of assembly 100 of FIGS. 1 and 2. For example, component 283' of member 284 may include a conductor for providing a portion of a cable assembly (e.g., a portion of a bus (e.g., a bus similar to bus 158 and/or cable region 112, 114, 116, and/or 118 of cable 110 of assembly 100)). Additionally or alternatively, component 283 of member 280 and/or component 283' of member 284 may include an antenna or a battery or any other suitable component or components of assembly 200. In some embodiments, at least a portion of a magnet of assembly 200 may be provided by at least a portion of another component of assembly 200 (e.g., any suitable mechanism (e.g., a transducer) of any suitable audio output component 256 (e.g., moving-iron speaker, magnetostatic speaker, magnetostrictive speaker, ribbon speaker, Heil air motion transducer speaker, electromagnetic speaker, and/or the like) of assembly 200 (e.g., an audio driver or speaker that may be at least partially provided within body 250) may provide at least a portion of magnet 252 and/or magnet 252' (e.g., a magnet with two poles in between which a coil of wire may be suspended and moved (e.g., via induction) to move a diaphragm to create sound waves)). In some embodiments, member 280 and/or member 284 may be an independent component not physically extending from body 250 but may be a distinct component that may be coupled to body 250 via magnetism between a magnet of body 250 and a magnet of member 280 and/or member 284.

Figure 3B:
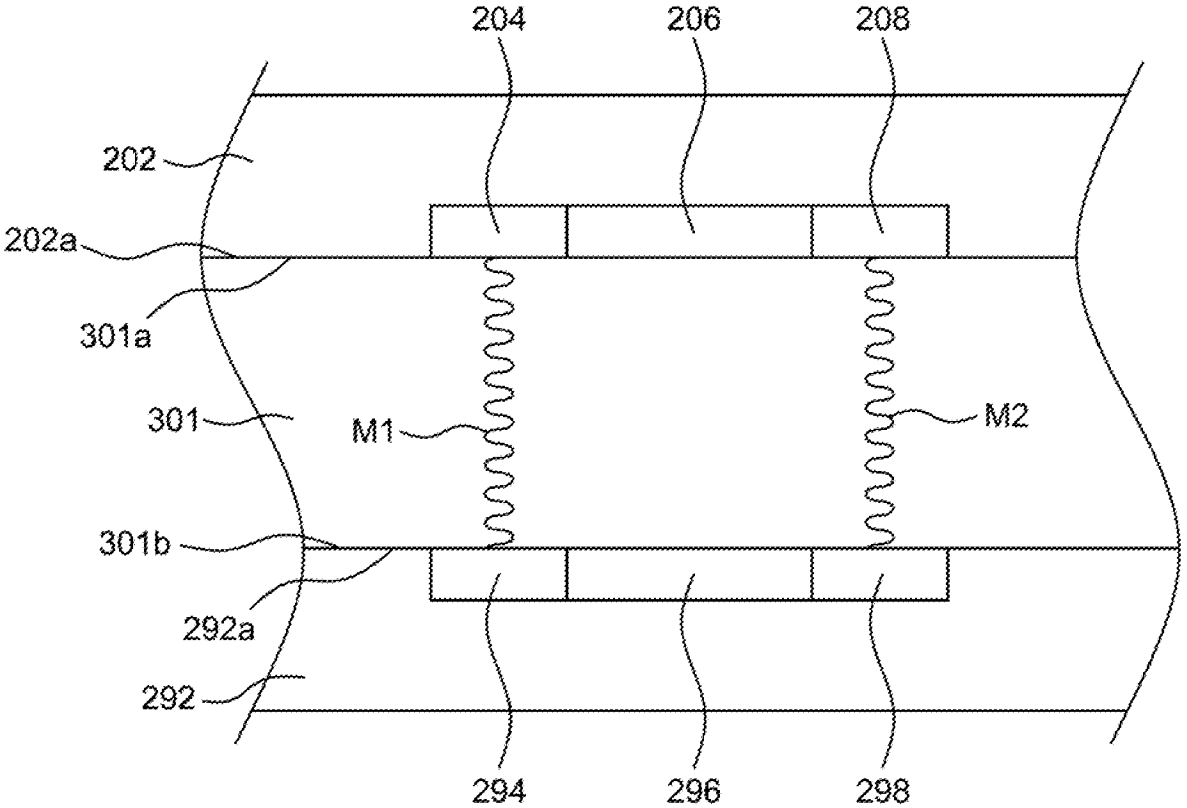
FIG. 3B is another cross-sectional view of a portion of the assembly and user of FIG. 3.

Such attraction between magnets of assembly 200 through a portion of ear 300 may be operative to position at least one sensor of assembly 200 with respect to ear 300 in any suitable manner. For example, a sensor of assembly 200 may operate more reliably if held close to or directly against a portion of ear 300 (e.g., one or more PPG sensors or ECG sensors). For example, as shown in FIG. 3B, a first assembly part 202 of assembly 200 (e.g., member 284, member 284', or body 250) may include a first magnet 204, a second magnet 208, and a sensor 206, each of which may be at least partially exposed through or provided adjacent to an external surface 202*a* of part 202 that may be operative to lie against a first external surface 301*a* of user body 301 (e.g., ear 300). As also shown in FIG. 3B, a second assembly part 292 of assembly 200 (e.g., member 284, member 284', or body 250) that is different than first assembly part 202 may include a first magnet 294, a second magnet 298, and a sensor 296, each of which may be at least partially exposed through or provided adjacent to an external surface 292*a* of part 292 that may be operative to lie against a second external surface 301*b* of user body 301 (e.g., ear 300). When aligned as shown in FIG. 3B, magnet 204 may be aligned with magnet 294 for generating magnetism M1 via body 301 for holding assembly part 202 with respect to part 292, and/or magnet 208 may be aligned with magnet 298 for generating magnetism M2 via body 301 for holding assembly part 202 with respect to part 292. The positional relationship of sensor 206 with respect to one or more of magnets 204 and 208 and/or based on the positional relationship of sensor 296 with respect to one or more of magnets 294 and 298 may enable sensor 206 to be held against or proximal to surface 202*a* and/or may enable sensor 296 to be held against or proximal to surface 202*b* and/or may enable sensor 206 and sensor 296 to be held adjacent to one another across body 301 (e.g., for enabling proper functionality of sensor 206 and/or sensor 296). Each magnet may have a portion exposed along a surface of an assembly part, or a portion of an assembly part (e.g., an external housing surface) may hide a magnet therebehind while still enabling the functionality of the magnet. Additionally or alternatively, each sensor may have a portion exposed along a surface of an assembly part, or a portion of an assembly part (e.g., an external housing surface) may hide a sensor therebehind while still enabling the functionality of the sensor.

Figure 3C:
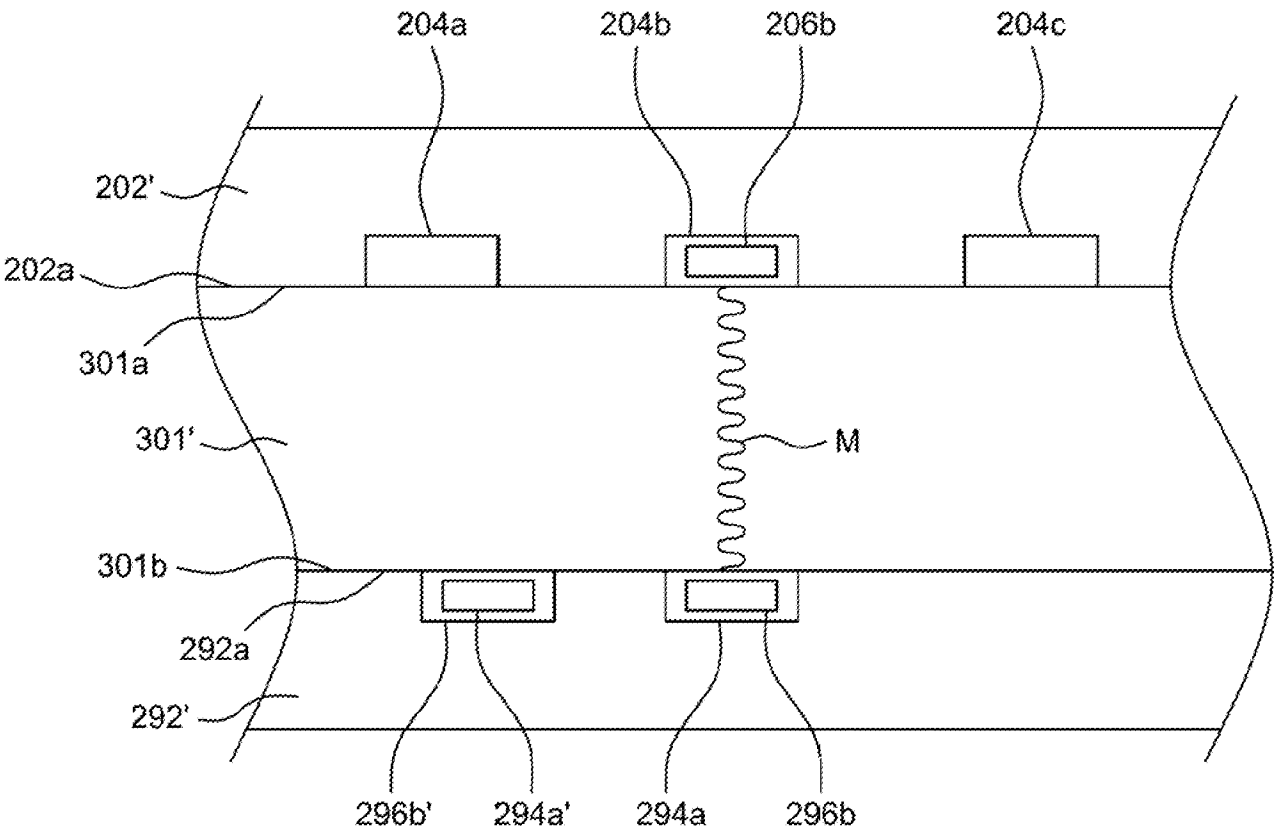
FIG. 3C is another cross-sectional view of a portion of the assembly and user of FIG. 3.

Attraction between magnets of assembly 200 through a portion of ear 300 may be operative to more comfortably position different portions of assembly 200 with respect to ear 300. For example, as shown in FIG. 3C, a first assembly part 202' of assembly 200 (e.g., member 284, member 284', or body 250) may include a first magnet 204*a*, a second magnet 204*b*, and a third magnet 204*c*, each of which may be at least partially exposed through or provided adjacent to an external surface 202*a* of part 202' that may be operative to lie against a first external surface 301*a* of user body 301 (e.g., ear 300). As also shown in FIG. 3C, a second assembly part 292' of assembly 200 (e.g., member 284, member 284', or body 250) that is different than first assembly part 202' may include a first magnet 294*a*, which may be at least partially exposed through or provided adjacent to an external surface 292*a* of part 292' that may be operative to lie against a second external surface 301*b* of user body 301 (e.g., ear 300). Part 202' may be moved with respect to part 292' such that magnet 294*a* of part 292' may be aligned via body 301 with a particular one of magnets 204*a*-204*c* of part 202' (e.g., magnet 204*b* for generating magnetism M via body 301 for holding assembly part 202' with respect to part 292', as shown in FIG. 3C). Which one of magnets 204*a*-204*c* of part 202' is aligned with magnet 294*a* of part 292' may determine how loose or tight assembly 200 may be worn on ear 300 (e.g., based on the size of ear 300, a different one of magnets 204*a*-204*c* may be aligned with magnet 294*a* for providing a comfortable fit on ear 300). In some embodiments, as shown, a sensor 206*b* may be provided at least partially within magnet 204*b* and/or a sensor 296*b* may be provided at least partially within magnet 294*a* for being functionally positioned with respect to ear 300 when magnets 294*a* and 204*b* are functionally aligned with each other via body 301. Alternatively, as shown, a magnet 294*a'* may be positioned within a sensor 296*b*'. Therefore, a sensor may be positioned within, adjacent, behind, about, or otherwise in any other suitable position with respect to at least one magnet for enabling proper functional positioning of the sensor with respect to ear 300 when the at least one magnet is attracted to another magnet of the assembly. Therefore, a consistent pressure of a sensor on, towards, or against a surface of ear 300 may be maintained by magnetism to enable proper functionality of that sensor. Each magnet may be any suitable material, such as a rare earth magnet (e.g., neodymium magnets and/or samarium-cobalt magnets), any magnetic permeable material (e.g., to form a portion of body 250, etc.), and/or the like.

While there have been described earphone assemblies with magnets for anchoring to a user, it is to be understood that many changes may be made therein without departing from the spirit and scope of the disclosure. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

Therefore, those skilled in the art will appreciate that the invention can be practiced by other than the described embodiments, which are presented for purposes of illustration rather than of limitation.

What is claimed is:

1. An earphone assembly for use by a user's ear, the earphone assembly comprising:
- a hook member comprising a functional component;
- a body;
- an audio output component positioned at least partially within the body;
- a first magnet physically coupled to the body; and
- a second magnet, wherein, when the body is positioned against the user's ear in a functional position that is operative to direct sound from the audio output component into the user's ear, the first magnet and the second magnet are operative to be positioned on opposite sides of a wall of the ear and are operative to be magnetically attracted to one another via the wall for holding the body in the functional position, and wherein:
  - a first end of the hook member is physically coupled to the body;
  - a second end of the hook member is a free end;
  - the second magnet is coupled to the hook member adjacent the second end of the hook member; and
  - the functional component comprises at least one of the following:
    - an antenna functionally coupled to the audio output component; and
    - a battery functionally coupled to the audio output component.

2. The earphone assembly of claim 1, wherein the at least one comprises the antenna functionally coupled to the audio output component.

3. The earphone assembly of claim 1, wherein the at least one comprises the battery functionally coupled to the audio component.

4. The earphone assembly of claim 3, wherein the at least one further comprises the antenna functionally coupled to the audio output component.

5. The earphone assembly of claim 1, wherein the free end of the hook member is operative to move in at least one direction of freedom with respect to the first end of the hook member.

6. The earphone assembly of claim 1, wherein, when the body is positioned in the functional position, a portion of the hook member extends up over a helix of the ear.

7. The earphone assembly of claim 1, wherein, when the body is positioned in the functional position, a portion of the hook member extends down under a lobe of the ear.

8. The earphone assembly of claim 1, further comprising:
- a third magnet physically coupled to the body; and
- a fourth magnet, wherein, when the body is positioned in the functional position, the third magnet and the fourth magnet are operative to be positioned on opposite sides of another wall of the ear and are operative to be magnetically attracted to one another via the other wall for holding the body in the functional position.

9. The earphone assembly of claim 8, further comprising another hook member, wherein:

a first end of the other hook member is physically coupled to the body;

a second end of the other hook member is a free end; and the fourth magnet is coupled to the other hook member adjacent the second end of the other hook member.

10. The earphone assembly of claim 9, wherein:

when the body is positioned in the functional position, a portion of the hook member extends up over a helix of the ear; and when the body is positioned in the functional position, a portion of the other hook member extends down under a lobe of the ear.

11. The earphone assembly of claim 9, wherein:

the other hook member comprises another functional component;

the other functional component comprises an antenna functionally coupled to the audio output component.

12. The earphone assembly of claim 9, wherein:

the other hook member comprises another functional component;

the other functional component comprises a battery functionally coupled to the audio component.

13. An earphone assembly for use by a user's ear, the earphone assembly comprising:

a body;

an audio output component positioned at least partially within the body;

a hook member comprising:

a first end physically coupled to the body;

a second end that is a free end; and a hook member part extending between the first end and the second end;

a first magnet physically coupled to the body;

a second magnet provided at a first position along a length of the hook member part; and a third magnet provided at a second position along the length of the hook member part, wherein:

when the body is positioned against the user's ear in a functional position that is operative to direct sound from the audio output component into the user's ear, the first magnet and the second magnet are operative to be positioned on opposite sides of a first portion of a wall of the ear and are operative to be magnetically attracted to one another via the first portion of the wall for holding the body in the functional position, and when the body is positioned against the user's ear in another functional position that is operative to direct sound from the audio output component into the user's ear, the first magnet and the third magnet are operative to be positioned on opposite sides of a second portion of the wall of the ear and are operative to be magnetically attracted to one another via the second portion of the wall for holding the body in the other functional position.

14. The earphone assembly of claim 13, wherein, when the body is positioned in the functional position, a portion of the hook member part extends up over a helix of the ear.

15. The earphone assembly of claim 13, wherein, when the body is positioned in the functional position, a portion of the hook member part extends down under a lobe of the ear.

16. An earphone assembly for use by a user's ear, the earphone assembly comprising:

a body, an audio output component comprising a first magnet positioned at least partially within the body;

a second magnet, wherein, when the body is positioned against the user's ear in a functional position that is operative to direct sound from the audio output component into the user's ear, the first magnet and the second magnet are operative to be positioned on opposite sides of a wall of the ear and are operative to be magnetically attracted to one another via the wall for holding the body in the functional position; and a hook member, wherein, a first end of the hook member is physically coupled to the body;

a second end of the hook member is a free end; and the second magnet is coupled to the hook member adjacent the second end of the hook member.

17. The earphone assembly of claim 16, wherein the first magnet comprises a permanent magnet of the audio output component.

18. The earphone assembly of claim 17, wherein a coil of the audio output component is operative to move between poles of the permanent magnet to direct the sound from the audio output component into the user's ear.

19. The earphone assembly of claim 16, wherein the free end of the hook member is operative to move in at least one direction of freedom with respect to the first end of the hook member.

* * * * *